US006497221B1

(12) United States Patent
French et al.

(10) Patent No.: US 6,497,221 B1
(45) Date of Patent: Dec. 24, 2002

(54) FEEDBACK TAILORING OF FUEL INJECTOR DRIVE SIGNAL

(75) Inventors: Richard Mark French, Livonia; Maria Catherine Nowland, Saline, both of MI (US)

(73) Assignee: Robert Bosch Corporation, Carol Stream, IL (US)

( * ) Notice: Subject to any disclaimer, the term of this patent is extended or adjusted under 35 U.S.C. 154(b) by 11 days.

(21) Appl. No.: 09/707,174

(22) Filed: Nov. 6, 2000

(51) Int. Cl.[7] ..... F02M 51/00
(52) U.S. Cl. ..... 123/478; 123/490
(58) Field of Search ..... 123/478, 490, 123/494; 73/119 A; 361/152, 153, 154

(56) References Cited

U.S. PATENT DOCUMENTS

| | | | | |
|---|---|---|---|---|
| 3,969,614 | A | | 7/1976 | Moyer et al. |
| 4,180,020 | A | | 12/1979 | Reddy |
| 4,200,063 | A | | 4/1980 | Bowler |
| 4,350,132 | A | | 9/1982 | Harsch et al. |
| 4,391,253 | A | | 7/1983 | Ito |
| 4,402,294 | A | | 9/1983 | McHugh et al. |
| 4,417,201 | A | * | 11/1983 | Reddy ..... 123/490 |
| 4,438,496 | A | | 3/1984 | Ohie |
| 4,479,161 | A | | 10/1984 | Henrich et al. |
| 4,494,507 | A | | 1/1985 | Yasuhara |
| 4,561,396 | A | | 12/1985 | Sakamoto et al. |
| 4,563,993 | A | | 1/1986 | Yamauchi et al. |
| 4,612,597 | A | * | 9/1986 | Hamren ..... 361/152 |
| 4,630,582 | A | | 12/1986 | Kuttner et al. |
| 4,798,188 | A | | 1/1989 | Ito et al. |
| 4,916,635 | A | | 4/1990 | Singer et al. |
| 5,057,734 | A | | 10/1991 | Tsuzuki et al. |
| 5,219,398 | A | | 6/1993 | Nonaka et al. |
| 5,499,608 | A | | 3/1996 | Meister et al. |
| 5,594,309 | A | | 1/1997 | McConnell et al. |
| 5,605,136 | A | | 2/1997 | Nakashima |
| 5,615,655 | A | | 4/1997 | Shimizu |
| 5,638,267 | A | | 6/1997 | Singhose et al. |
| 5,832,901 | A | | 11/1998 | Yoshida et al. |
| 5,839,420 | A | | 11/1998 | Thomas |
| 5,912,821 | A | | 6/1999 | Kobayashi |
| 6,002,232 | A | | 12/1999 | McConnell et al. |
| 6,011,373 | A | | 1/2000 | McConnell et al. |
| 6,101,082 | A | * | 8/2000 | Benkaroun et al. ..... 361/191 |

* cited by examiner

*Primary Examiner*—Willis R. Wolfe
*Assistant Examiner*—Johnny H. Hoang
(74) *Attorney, Agent, or Firm*—Michael Best & Friedrich LLP

(57) ABSTRACT

A method and system of adjusting a drive signal to a fuel injector or other electromagnetic device having an electromagnetic coil and an armature. The system includes an amplifier coupled to the electromagnetic coil by a link. A sensor is coupled to the link to measure the electric signal travelling through the link and produces an output signal based on the sensed electric signal. A controller coupled to the amplifier and to the sensor produces a drive signal for the electromagnetic coil. The controller determines the position of the armature based on the output signal of the sensor, and modifies the drive signal based on the position of the armature. The method includes sending a drive signal to a fuel injector, sensing whether the armature contacts the body of the fuel injector, running the injector with the drive signal if no contact is detected, and upon sensing contact between the armature and the body, modifying the drive signal. If the armature contacts the body of the fuel injector when driven by the modified drive signal, the controller modifies the modified drive signal until no contact between the armature and the body is detected. Then, the injector is run using the modified signal. The drive signal if preferably modified by notching the drive signal or stepping the drive signal.

27 Claims, 5 Drawing Sheets

FEEDBACK TAILORING OF FUEL INJECTOR DRIVE SIGNAL

BACKGROUND OF THE INVENTION

The present invention relates to fuel injectors. More particularly, the invention relates to methods and devices used to control the actuation of fuel injectors.

Modem internal combustion engines rely on electronically controlled fuel injection systems. Mechanical injectors spray or otherwise dispense fuel within the combustion chamber(s) of the engine at specific times. The timing of fuel dispensing and the amount of fuel dispensed affects engine performance in a myriad of ways. While systems have been developed to control fuel injectors, these systems suffer from several deficiencies.

As is known, a fuel injector has an electromagnetic coil that is used to open and close a fuel-metering valve to control the flow of fuel into the engine. In most conventional fuel systems, the drive signal delivered to the coil is an amplified square wave. The square wave deteriorates slightly as it is amplified and run through the coil. Thus, the signal delivered to the fuel injector is not a true square wave. One deficiency in modem systems is that distorted square wave signals cause the armature to forcefully drive the valve into end stops positioned at either end of the path of travel of the valve. When the valve contacts the stops, the valve bounces. This generates an unpleasant noise and excessive wear of the valve and stops.

SUMMARY OF THE INVENTION

In light of the noted noise and wear problems of present fuel injection systems, there is a need for an improved fuel injection system that eliminates or reduces valve or armature bounce.

The present invention includes a fuel injector control system that modifies the control signal sent to the electromagnetic coil of a fuel injector. The control system has a microprocessor or other programmable device that delivers an output signal to an amplifying circuit such as a power transistor. The microprocessor modifies the control signal by notching or stepping the signal at times that correspond to the opening and closing of the injector valve. The notches in the signal help eliminate vibrations in the fuel injector caused by the impact of the valve contacting the stops within the injector. The microprocessor adjusts the notching of the drive signal by monitoring the electromagnetic characteristics of the fuel injector.

The invention also provides a method of driving a fuel injector that includes, sending a drive signal to a fuel injector, sensing whether the armature contacts the body of the fuel injector, running the injector with the drive signal if no contact is detected, and upon sensing contact between the armature and the body, modifying the drive signal. As noted, the drive signal is modified by notching or stepping the drive signal. The modified drive signal is reapplied to the fuel injector and the system then senses whether the armature contacts the body of the fuel injector when driven by the modified drive signal. The system continues to modify the signal until no contact between the armature and the body is detected. The injector is then run with the modified signal.

As is apparent from the above, it is an advantage of the present invention to provide a method and system for controlling a fuel injector. Other features and advantages of the present invention will become apparent by consideration of the detailed description and accompanying drawings.

DETAILED DESCRIPTION

Figure 1:
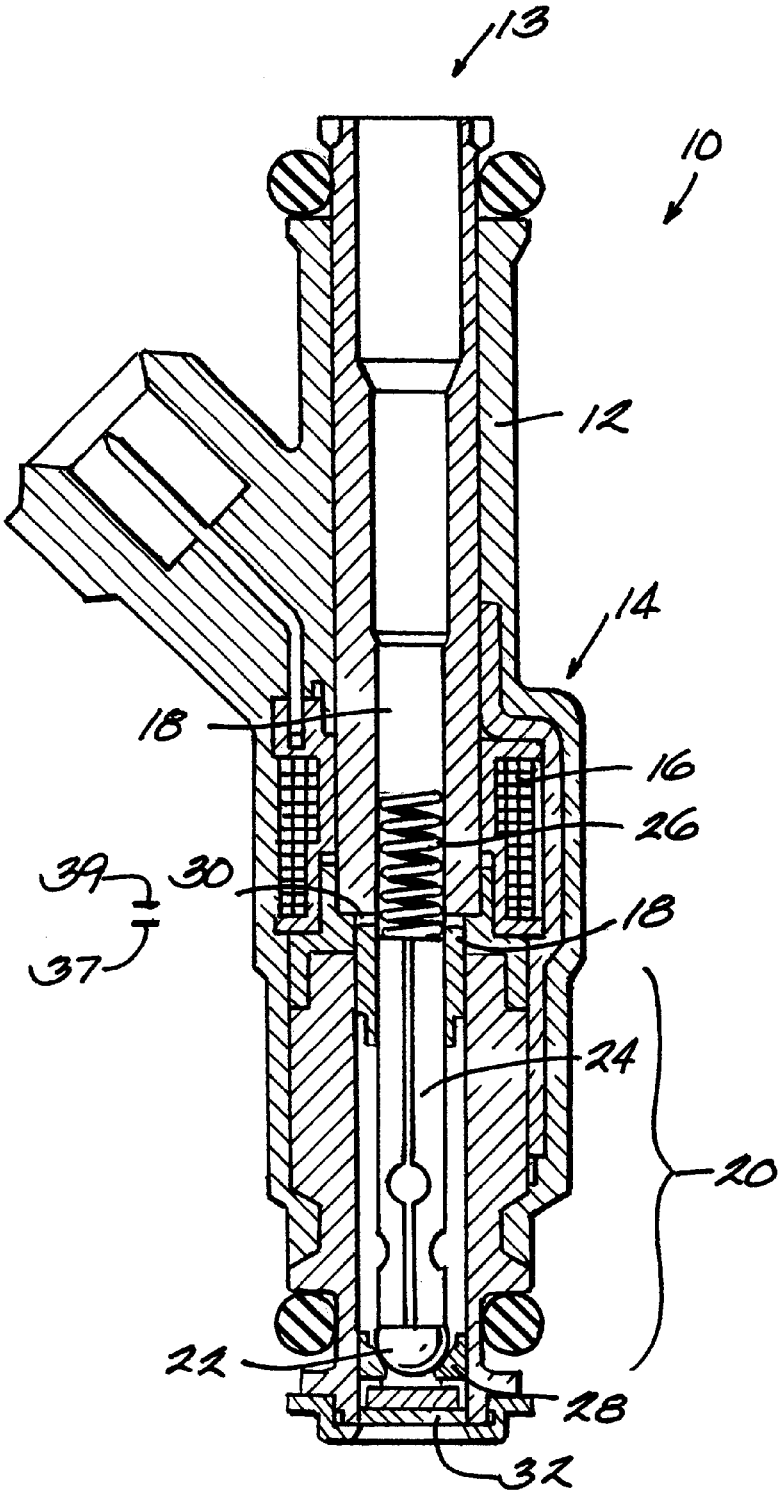
FIG. 1 PRIOR ART
FIG. 1 is a cross sectional diagram of an exemplary fuel injector.

Before one embodiment of the invention is explained in detail, it is to be understood that the invention is not limited in its application to the details of the construction and the arrangements of the components set forth in the following description or illustrated in the drawings. The invention is capable of other embodiments and of being practiced or being carried out in various ways. Also, it is to be understood that the phraseology and terminology used herein is for the purpose of description and should not be regarded as limiting. In particular, although the invention is described in relation to a fuel injector, the control techniques described herein are applicable to similar devices such as antilock braking system valves, intake, and exhaust valves, and other electromagnetically operated devices.

A fuel injector 10 is shown in FIG. 1. The fuel injector 10 includes a housing or molding 12. The molding 12 has an opening 13 for receiving a fuel line (not shown). A coil assembly 14 with an electromagnetic coil 16 is positioned in the molding 12. The electromagnetic coil 16 interacts with a magnetic armature 18 that is connected to a needle assembly 20. The needle assembly 20 includes a ball 22 and a needle 24. The needle 24 is biased in a closed position by a spring 26 such that the ball 22 is seated in a seat 28. When the electromagnetic coil 16 is energized, the armature 18 is drawn upwards to contact a stop 30. The needle 24, which is attached to the armature 18 is also drawn upwards resulting in the ball 22 leaving the seat 28 and the forceful ejection of fuel out of a metering plate 32 positioned at the bottom of the fuel injector 10.

Figure 2:
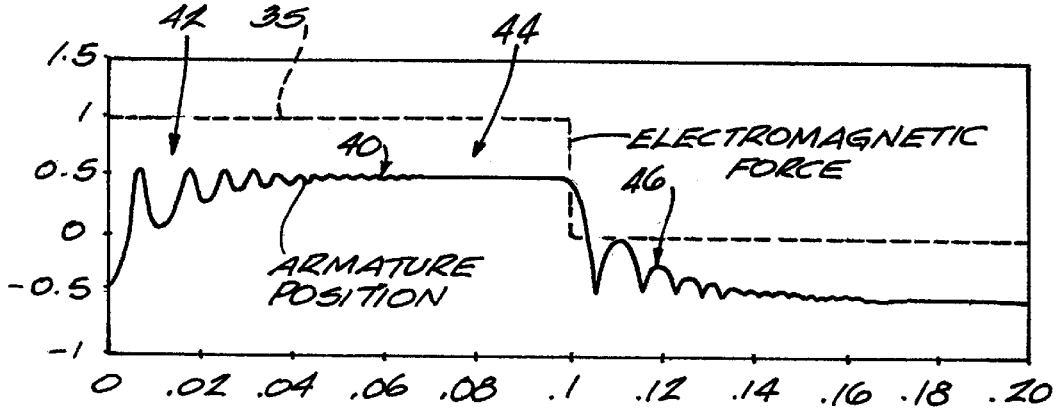
Fig. 2. PRIOR ART
FIG. 2 is a waveform diagram illustrating the movement of an armature in a fuel injector when driven by a square wave drive signal.

The fuel injector 10 is actuated by applying an electric signal to the electromagnetic coil. As shown in FIG. 2, known fuel injector systems apply a square wave drive signal, such as the signal 35, to the electromagnetic coil. When the signal 35 is initially applied to the electromagnetic coil 16, the armature 18 moves between a first position 37, where the ball 22 is seated in the seat 28, i.e., the injector is closed, to a second position 39, where the ball 22 is unseated, i.e., the injector is open. The injector is held open for a predetermined period of time depending on the amount of fuel that is to be dispensed and then the drive signal is removed or reduced to zero amplitude. As can be seen by reference to the waveform 40, in response to the drive signal, the armature 18 moves from the position 37 to the position 39, but strikes the stop 30 with such force that the armature 18 oscillates for a period of time, as shown in portion 42 of the waveform 40. The armature 18 then remains in a static open position, as is shown by portion 44 of the waveform 40. When the drive signal is removed, the armature 18 then moves back to the position 37. The ball 22 strikes the seat 28 such that the armature 18 oscillates for a second period of time, as is shown by portion 46 of the waveform 40. The oscillation of the armature 18 and ball 22 against the stop 30 and seat 28 causes noise and wear in the injector 10.

Figure 4:
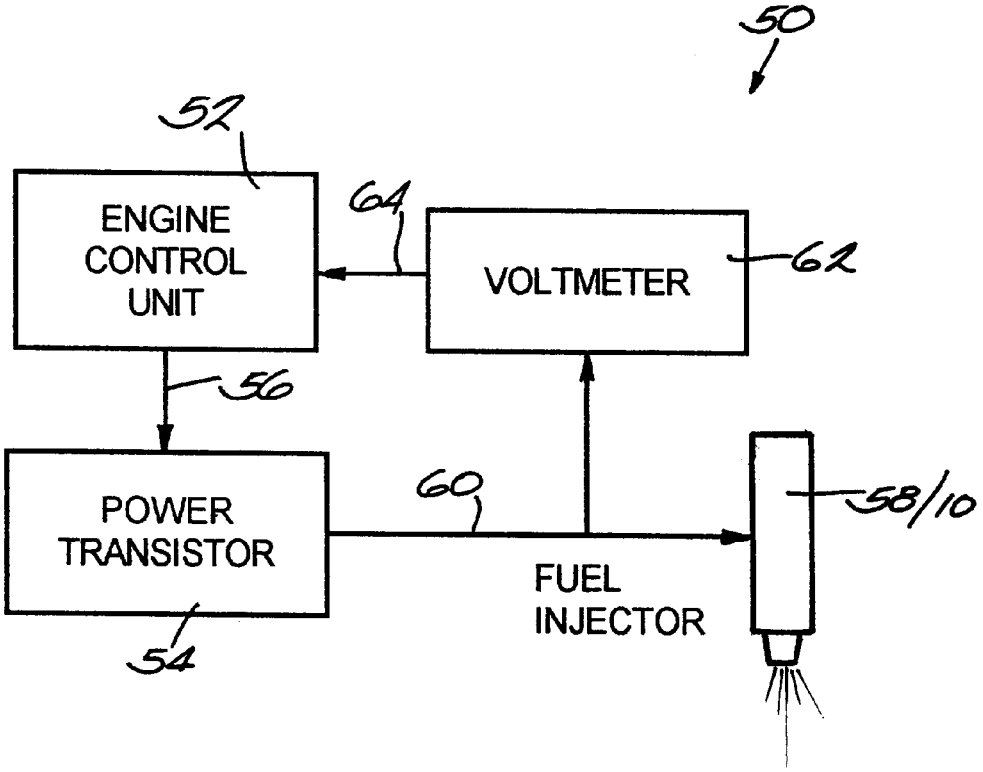
FIG. 4 is a schematic diagram of an injector control system of the invention.

The inventors have discovered that the oscillation of the armature can be reduced by modifying the drive signal. A fuel injector control system 50 of the invention is shown in FIG. 4. The system includes an engine control unit 52, which includes a programmable processor (not shown). The engine control unit 52 generates an output signal that is sent to an amplifier 54 over a link 56. The amplifier 54 may take the form of a power transistor. The amplifier 54 provides a drive signal to a fuel injector 58 over a link 60. The fuel injector 58 may be almost any type of fuel injector that operates under substantially the same operating principles of the fuel injector 10. For purposes of discussion, it is assumed that the fuel injector 58 has an armature and electromagnetic coil that are the same or equivalent to those described with respect to the injector 10. Furthermore, component parts of the injector 10 will be used in the discussion below, although its should be understood that it is immaterial whether the injector 10, 58, or other injector is used in the invention.

A sensor 62, which may take the form of a voltmeter (shown) or an ammeter (not shown) samples a feedback signal from the link 60 and delivers that feedback signal over a link 64 to the engine control unit 52.

Figure 3:
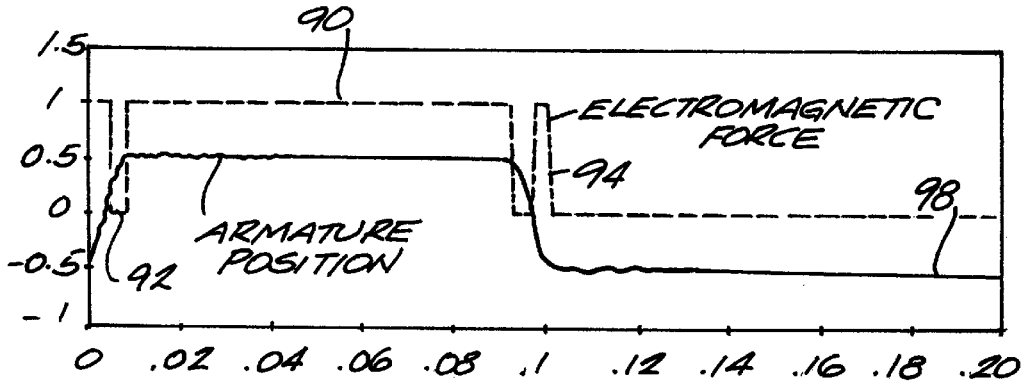
FIG. 3 is a waveform diagram illustrating the movement of an armature in a fuel injector when driven by a notched-wave drive signal.
Figure 5:
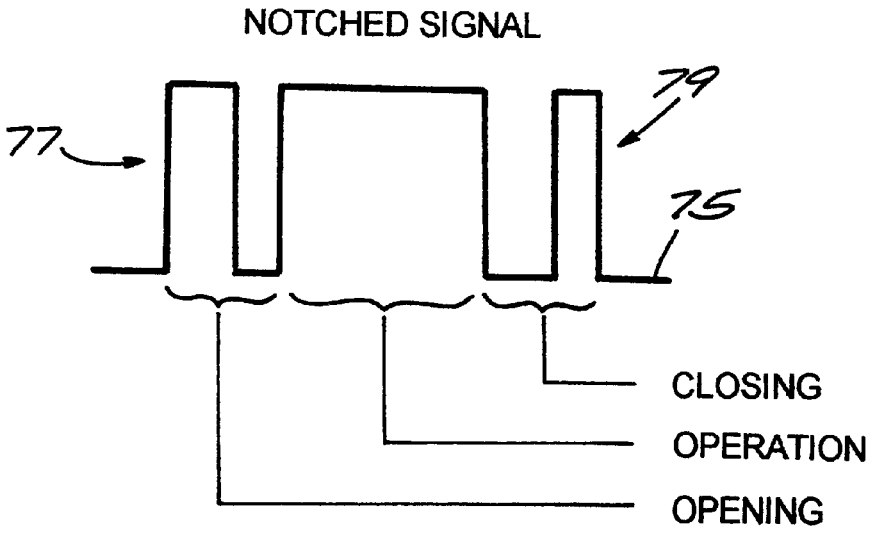
FIG. 5 is a waveform diagram illustrating the modification of a drive signal by notching.

The engine control unit 52 modifies the drive signal sent to the fuel injector 58 based on the feedback signal received from the sensor 62. In particular, the engine control unit 52 determines the position of the armature 18 based on the output signal of the sensor 62 and modifies the drive signal to prevent oscillation of the armature 18. FIGS. 3 and 5 illustrate one embodiment of the invention where the drive signal is modified by notching.

As shown in FIG. 5, an exemplary drive signal 75 includes an opening notch 77 and a closing notch 79. The effect of these notches on the movement of the armature 18 is illustrated in FIG. 3. As shown, applying a notched drive signal 90 having a trough 92 and an impulse 94 results in an armature waveform 98 with little or no oscillation. The engine control unit 52 controls the location and duration of the notches such that oscillation of the armature 18 is controlled during opening of the fuel injector by momentarily reducing the amount of energy applied to the electromagnetic coil. Conversely, oscillation of the armature 18 during closing is controlled by applying an impulse of energy.

Figure 6:
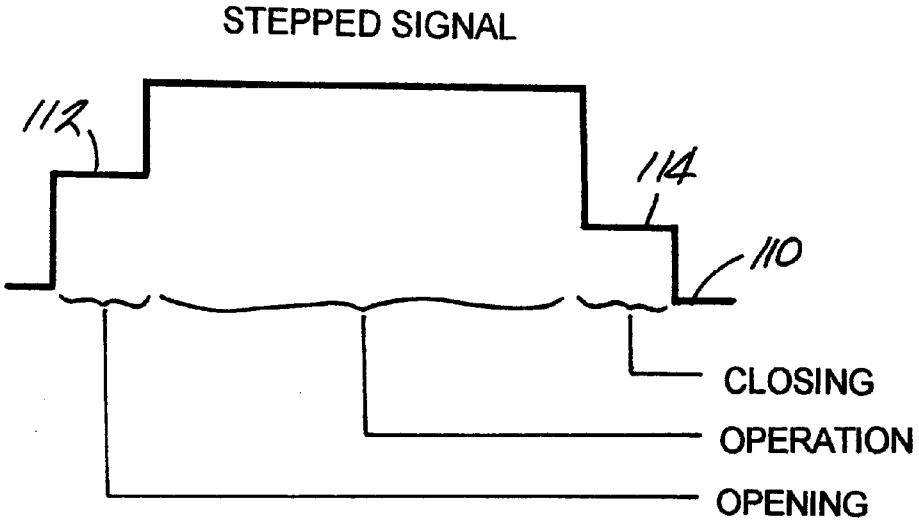
FIG. 6 is a waveform diagram illustrating the modification of a drive signal by stepping.

In addition to modifying the drive signal by notching, stepping the drive signal is also effective in reducing oscillation of the armature 18. FIG. 6 illustrates a drive signal 110 having an opening step 112 and a closing step 114. The engine control unit controls the height and duration of the opening and closing steps 112 and 114.

Figure 7:
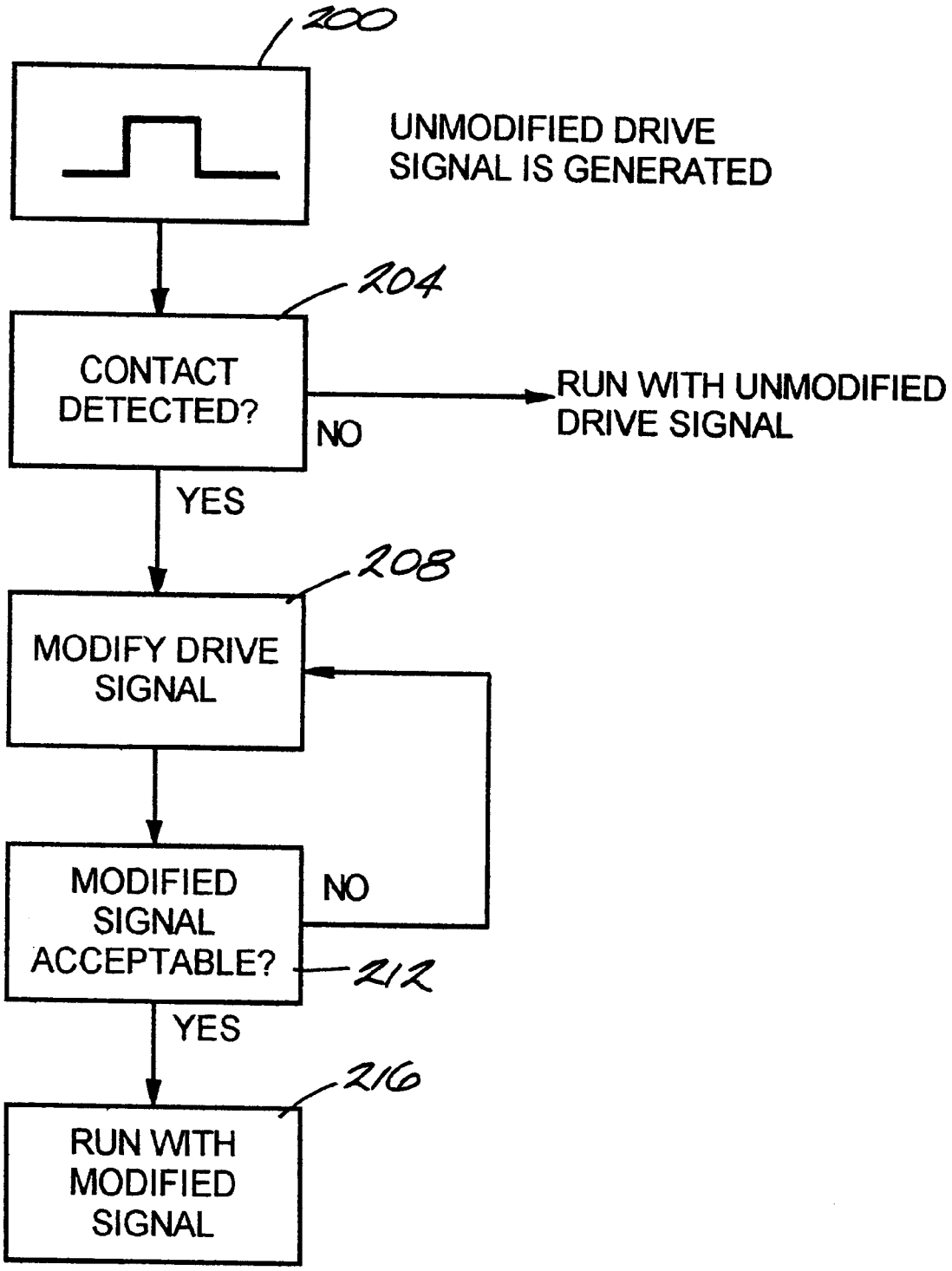
FIG. 7 is a flowchart of the control and signal modification process of the invention.

The algorithm implemented via software installed on the engine control unit 52 is illustrated in the flow chart of FIG. 7. As shown at step 200, the engine control unit 52 generates and sends an unmodified drive signal to the fuel injector 58. At step 204, the engine control unit 52 senses whether the armature contacts the body of the fuel injector using the feedback signal from the sensor 62. If no contact is sensed, then the fuel injector is run with the original drive signal. If contact is detected, the drive signal is modified as shown in step 208. The engine control unit 52 then rechecks whether the armature contacts the body of the fuel injector when driven by the modified drive signal, as shown at step 212. If contact is detected, the signal is modified further. The armature contact is continually checked and the drive signal modified until an acceptable level of vibration is detected. The multiple modified drive signal is then used to run the fuel injector, as shown at step 216.

As can be seen from the above, the present invention provides a fuel injector control system that reduces meter-valve bounce and the wear associated with that bounce. Various features and advantages of the invention are set forth in the following claims.

What is claimed is:

1. A system for controlling an electromagnetic coil and an armature, the system comprising:

an amplifier coupled to the electromagnetic coil by a link;

a sensor coupled to the link to measure an electric signal travelling through the link and operable to produce an output signal; and a controller coupled to the amplifier and to the sensor and operable to produce a drive signal for the electromagnetic coil, the controller further operable to determine a position of the armature based on the output signal of the sensor, wherein the drive signal is modified based on the position of the armature and the drive signal is notched such that it has an opening notch and a closing notch.

2. A system as claimed in claim 1, wherein the amplifier is a transistor.

3. A system as claimed in claim 1, wherein the sensor is a voltage sensor.

4. A system as claimed in claim 1, wherein the sensor is a current sensor.

5. A system as claimed in claim 4, wherein a location and duration of the opening and closing notches are controlled by the controller.

6. A system as claimed in claim 1, wherein the drive signal is modified to have an opening step and a closing step.

7. A system as claimed in claim 6, wherein a height and duration of the opening and closing steps are controlled by the controller.

8. A system as claimed in claim 1, wherein the controller is an engine control unit.

9. A method of modifying a drive signal to a fuel injector having an armature and a body, the method comprising:

sending the drive signal to a fuel injector;

sensing whether the armature contacts the body of the fuel injector;

running the fuel injector with the drive signal if no contact is detected;

upon sensing contact between the armature and the body, modifying the drive signal;

repeating the acts of sensing contact and modifying the drive signal until no contact between the armature and the body is detected; and running the fuel injector with the modified drive signal.

10. A method as claimed in claim 9, wherein the act of modifying the drive signal includes notching the drive signal.

11. A method as claimed in claim 10, wherein notching the drive signal includes creating an opening notch and a closing notch.

12. A method as claimed in claim 11, wherein notching the drive signal includes controlling a location and duration of the opening and closing notches.

13. A method as claimed in claim 9, wherein the act of modifying the drive signal includes stepping the drive signal.

14. A method as claimed in claim 13, wherein stepping the drive signal includes creating an opening step and a closing step.

15. A method as claimed in claim 14, wherein stepping the drive signal includes controlling a height and duration of the opening and closing steps.

16. A method as claimed in claim 9, wherein the act of sensing whether the armature contacts the body of the fuel injector includes sensing a current of the drive signal.

17. A method as claimed in claim 9, wherein the act of sensing whether the armature contacts the body of the fuel injector includes sensing a voltage of the drive signal.

18. A method as claimed in claim 9, wherein the act of sending the drive signal to the fuel injector involves generating a square wave.

19. A system for controlling an electromagnetic coil and an armature, the system comprising:

an amplifier coupled to the electromagnetic coil by a link;

a sensor coupled to the link to measure a signal travelling through the link and operable to produce an output signal;

a controller coupled to the amplifier and to the sensor and operable to produce a drive signal for the electromagnetic coil, the controller further operable to determine a position of the armature based on the output signal of the sensor, wherein the drive signal is modified by being either notched or stepped based on the position of the armature and the drive signal is notched such that it has an opening notch and a closing notch.

20. A system as claimed in claim 19, wherein the amplifier is a transistor.

21. A system as claimed in claim 19, wherein the sensor is a voltage sensor.

22. A system as claimed in claim 19, wherein the sensor is a current sensor.

23. A system as claimed in claim 19, wherein a location and duration of the opening and closing notches are controlled by the controller.

24. A system as claimed in claim 19, wherein the drive signal is modified to have an opening step and a closing step.

25. A system as claimed in claim 19, wherein a height and duration of the opening and closing steps are controlled by the controller.

26. A system as claimed in claim 19, wherein the controller is an engine control unit.

27. A system for controlling an electromagnetic coil and an armature, the system comprising:

an amplifier operable to be coupled to the electromagnetic coil by a link;

a sensor operable to be coupled to the link to sense an electric signal travelling through the link and operable to produce an output signal; and a controller operable to be coupled to the amplifier and to the sensor and operable to produce a drive signal for the electromagnetic coil, the controller further operable to determine a position of the armature based on the output signal of the sensor, wherein the drive signal is modified based on the position of the armature and the drive signal is notched such that it has an opening notch and a closing notch.

* * * * *